US007488012B2

(12) United States Patent
Eller et al.

(10) Patent No.: US 7,488,012 B2
(45) Date of Patent: Feb. 10, 2009

(54) THERMAL PIN ASSEMBLY

(75) Inventors: Darren C Eller, East Lyme, CT (US); Brett E Tannone, Newtown, CT (US)

(73) Assignee: Sargent Manufacturing Company, New Haven, CT (US)

( * ) Notice: Subject to any disclaimer, the term of this patent is extended or adjusted under 35 U.S.C. 154(b) by 0 days.

(21) Appl. No.: 11/534,053

(22) Filed: Sep. 21, 2006

(65) Prior Publication Data

US 2008/0073914 A1 Mar. 27, 2008

(51) Int. Cl.
*E05C 1/12* (2006.01)
*E05C 1/02* (2006.01)

(52) U.S. Cl. ..... 292/164; 292/137; 292/163; 292/DIG. 66

(58) Field of Classification Search ..... 292/137, 292/163, 164, DIG. 66
See application file for complete search history.

(56) References Cited

U.S. PATENT DOCUMENTS 3,325,941 A * 6/1967 Prucha ..... 49/7
4,015,869 A 4/1977 Horvath
4,183,565 A * 1/1980 Allemann ..... 292/163
4,674,780 A * 6/1987 Weinerman et al. ..... 292/336.3
4,714,285 A * 12/1987 Langham ..... 292/163
4,726,613 A 2/1988 Foshee
4,824,150 A 4/1989 Smith et al.
5,121,950 A * 6/1992 Davidian ..... 292/164
5,380,053 A * 1/1995 Saino ..... 292/144
5,427,420 A * 6/1995 Moore ..... 292/169
5,464,259 A 11/1995 Cohrs et al.
5,690,371 A * 11/1997 Turnbull ..... 292/163
5,782,509 A * 7/1998 Uyeda ..... 292/92

* cited by examiner

*Primary Examiner*—Carlos Lugo
(74) *Attorney, Agent, or Firm*—DeLio & Peterson, LLC

(57) ABSTRACT

A pin assembly includes a spring held in compression inside a case by a thermal fuse located at the back end of the pin. The fuse is thermally activated to collapse, which allows the back end of the pin to move forward. The spring drives the front end of the pin out of the case into latching engagement between a first object, such as a fire door, and a second object, such as a floor or a doorframe. The fuse and spring are located on opposite sides of a restrictive opening at the back end of the case. The fuse is preferably cylindrical, surrounds the back end of the pin and is provided with holes oriented perpendicular to the cylindrical axis of the fuse forming a web. The holes weaken the fuse and cause it to collapse in a controlled manner at the desired activation temperature.

26 Claims, 1 Drawing Sheet

THERMAL PIN ASSEMBLY

BACKGROUND OF THE INVENTION

1. Field of the Invention

The present invention relates to spring operated fire safety devices that are thermally activated to extend a pin and connect two objects, such as a fire door and an adjacent floor or doorframe.

2. Description of Related Art

Fire doors are designed to limit the spread of a fire within a building by preventing the passage of heat, smoke, flames and oxygen required for combustion. Fire safety regulations require that fire doors and door hardware resist the high temperature of a fire that they may be exposed to and hold the door securely closed.

Fire resistant steel doors are often used in these applications and will prevent the passage of fire through the door itself. However, steel doors may warp and move away from the doorframe or an adjacent door if subjected to very high temperatures. Any opening between a warped fire door and the doorframe may allow the escape of fire and smoke from the fire area and allow oxygen to pass into the fire area. Warping under extreme heat is a particularly difficult problem to solve when the door opening is two doors wide and two adjacent doors latch at the center of the opening.

This type of double door opening is found in many public buildings. Although the wide door opening allows for rapid movement of many people through the opening, the two adjacent doors may change shape and warp in different directions under intense heat. This differential warping increases the chance that an unacceptably wide opening will be created between the doors and allows the fire to pass through.

Warping is most easily controlled by door hardware incorporating vertical rods that latch at the top and bottom of the door to connect the door to the door frame and the floor. However, there are many door installations where it is desirable to eliminate the lower vertical rod to avoid the possibility of damage to the flooring. In these single vertical rod door hardware installations, there is a need to latch the bottom of the door to the floor or to another fixed object during a fire to prevent warping.

There are many other fire safety applications for thermally activated pin assemblies to ensure that two objects do not move relative to each other during a fire due to warping of components capable of resisting high temperatures or due to melting of lower temperature components door hardware.

SUMMARY OF THE INVENTION

The above and other objects, which will be apparent to those skilled in the art, are achieved in the present invention which is directed to a thermally activated pin assembly having a case and a pin received within the case that is movable between a retracted position and an extended position. A spring, preferably a coil spring, applies a biasing force between the case and the pin to urge the pin out of the case when released by thermal activation of a fuse.

The thermally activated fuse engages a back portion of the pin and acts between the case and the back portion of the pin to hold the pin in the retracted position against the spring biasing force prior to activation. The fuse allows the pin to move to the extended position when the heat of a fire thermally activates it.

In the preferred design, a front portion of the pin has a diameter greater than the back portion and the spring fits over the back portion, acting against the annular step formed at the diameter change between the front and back portions of the pin to provide the forward biasing force on the pin.

The fuse is preferably substantially cylindrical and the back portion of the pin extends through the fuse. In the preferred embodiment, the length of the cylindrical fuse, measured along an axis of the pin, is greater than the diameter of the fuse, measured perpendicular to the axis of the pin. A retaining ring is mounted on the back portion of the pin and prior to thermal activation, the fuse is held in compression between the case and the retaining ring.

In one embodiment, the fuse includes a plurality of holes formed perpendicular to a cylindrical axis of the fuse. The holes act to weaken the fuse and control the collapse of the fuse so that it is activated at a desired temperature.

In the most highly preferred embodiment, the front portion of the pin has a diameter greater than the back portion of the pin, the back portion of the pin extends though the spring, and, prior to thermal activation of the fuse, the spring is held in compression between the case and an annular step formed at the diameter change between the front and back portions of the pin.

The case is preferably designed with a restrictive opening sized to receive the back portion of the pin such that the back portion of the pin extends through the restrictive opening and the spring and the fuse are located on opposite sides of the restrictive opening. The spring provides a biasing force pushing the pin away from the restrictive opening and the fuse acts to prevent the back portion of the pin from moving through the restrictive opening until the fuse is thermally activated.

The case may be provided with a flange at a front end thereof which seats against a surface of the door or other object receiving the thermally activated pin assembly. In another aspect of the invention, the case includes at least one clip member at the front end thereof and the flange at the front end of the case has a flange diameter greater than the body diameter of the case. The clip member cooperates with the flange to hold the case within a mounting hole in the door or doorframe.

The pin is preferably longer than the case with the back portion of the pin extending out of the case and into the fuse. In this embodiment the spring acts to push the front portion of the pin out of the case and pull the back portion of the pin into the case. The fuse acts to prevent the back portion of the pin from moving into the case until the fuse is thermally activated.

In the most highly preferred embodiment, the fuse includes at least two holes extending perpendicular to a cylindrical axis of the fuse and adjacent to one another in spaced relation along the axis of the fuse, the holes acting to weaken the fuse and allow the fuse to collapse at the desired thermal activation temperature.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
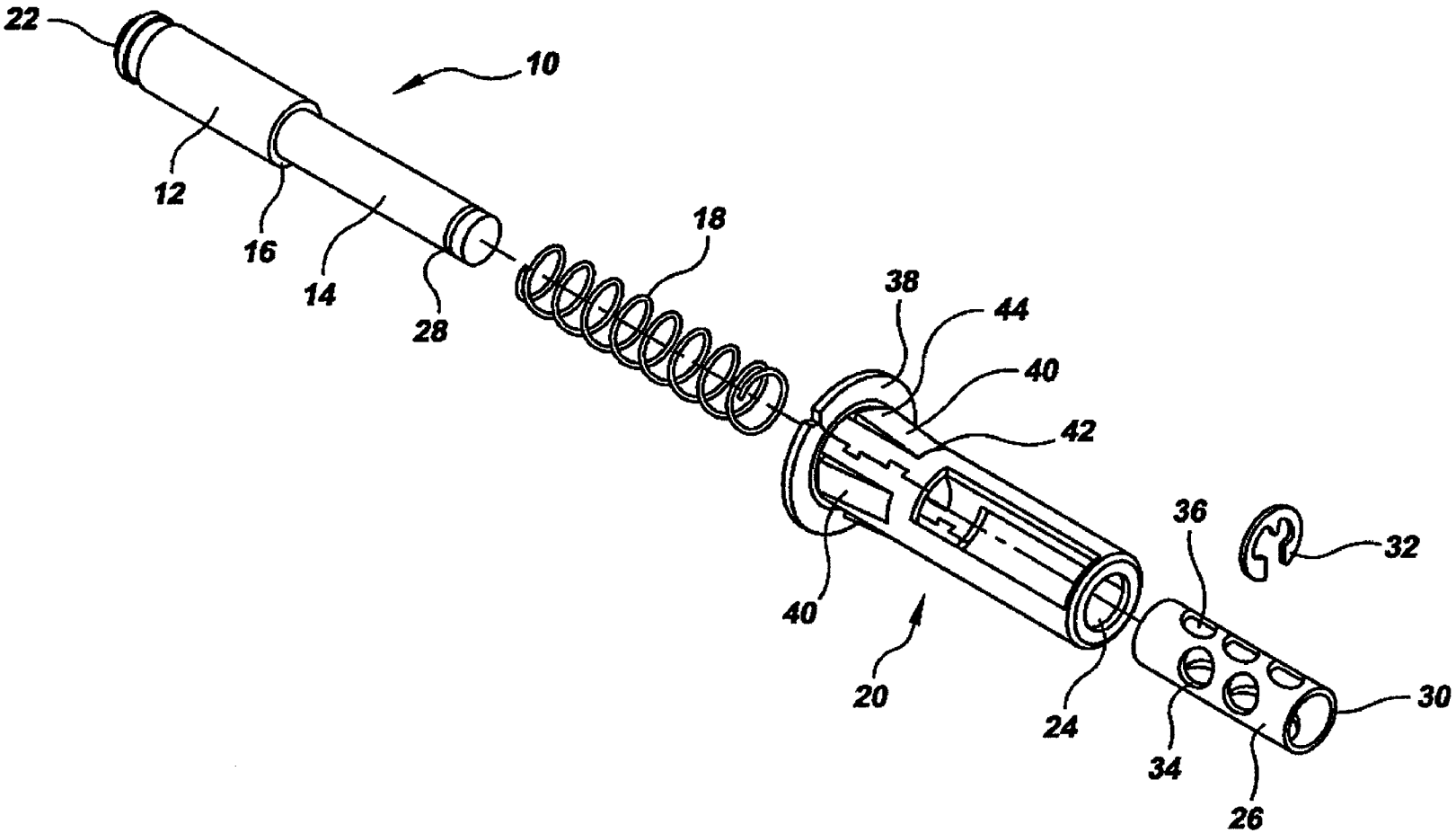
FIG. 1 is an exploded perspective view of a thermally activated pin assembly according to the present invention.

Referring to FIG. 1, the present invention includes a pin 10 having a front portion 12 and a back portion 14. The diameter of the front portion 12 is larger than the diameter of the back portion 14. This change in diameter produces an annular step 16 between the front portion and the rear portion.

A spring 18 is provided to power the pin assembly. The spring is held compressed until the heat of a fire releases it to drive the pin 10 forward. The spring 18 is a coil spring and has an inside diameter sufficiently large to receive the back portion 14 of the pin 10 and sufficiently small that the spring cannot move past the annular step 16. The annular step 16 acts as a seat for one end of the spring.

The outside diameter of the spring 18 and the front portion 12 of the pin are sufficiently small that they will fit within the case 20. When the spring assembly is manufactured, the coil spring 18 is placed over the back portion 14 of the pin and the pin is inserted into the case 20 until the head 22 is in approximate alignment with the front end of the case 20. The back portion 14 of the pin then extends out of the back end of the case 20 through a restrictive opening 24 and through a thermally activated fuse 26.

The back portion 14 of the pin is provided with an annular groove 28, which is located just beyond the back end 30 of the fuse 26 when the spring is compressed. The annular groove 28 receives a retaining clip 32. The spring 18 is compressed between the annular step 16 and the inner side of the case 20 at the restrictive opening 24. The fuse 26 is located on the opposite side of the restrictive opening 24 and is held in compression between the restrictive opening 24 and the retaining clip 32.

The fuse 26 is substantially cylindrical, having a length greater than its width, and is made of a plastic. The plastic can be of any type that deforms and/or melts with temperatures above the maximum temperature expected in normal conditions but below the temperatures reached during a fire and below the temperature required to substantially distort the associated fire door.

The desired activation temperature of the fuse 26 may be adjusted by a selection of the desired plastic material and the associated melting and deforming properties of the selected plastic material. In the preferred embodiment however, the fuse 26 is provided with one or more holes 34 that extend perpendicular to the cylindrical axis of the fuse. The holes 34 produce a series of adjacent separating walls 36 which form a web around the fuse.

The web defined by the holes 34 in the cylindrical fuse is sufficiently strong at normal operating temperatures to prevent the pin from moving forward under the biasing force of spring 18. However, when exposed to the elevated temperature of a fire, the web and fuse collapse allowing the spring to drive the pin 10 a sufficient distance out of the case 20 to engage an associated door frame, the floor or an adjacent door. The web defined by the holes in the fuse provides a controlled collapse of the fuse at a desired rate and amount of collapse corresponding to the temperature reached by the fuse during a fire.

The pin assembly is suitable for installation wherever it is desired to latch to adjacent objects in a fire. Typical installations include at the bottom edge of a fire door such that the pin 10 extends downward when released and into engagement with an opening in the floor. This installation is particularly suitable for side-by-side doors and/or for vertical rod door latching systems where the lower rod has been omitted to avoid any risk of injury to a flooring material. The pin assembly may also be used to latch adjacent doors and/or to connect a door to its doorframe to control warping.

The case 20 is provided with a flange 38 at the front end thereof. The pin assembly is typically installed by inserting the case into a hole drilled in the fire door or in some other object. The diameter of the installation hole is just slightly larger than the diameter of the case 20. The flange 38 has a larger diameter than the installation hole and ensures that the head 22 of the case lies approximately flush with the edge or other surface of the fire door into which the installation hole was drilled.

The case 20 is provided with multiple clip members 40 located at the front end thereof, which act to hold the pin assembly in the installation hole. The case is preferably formed of thin sheet steel produced by stamping and rolling. The clip members provide a resilient spring action by pivoting at the back end 42 where they are connected to the case so that the front end 44 is compressed inward as the pin assembly is inserted into the installation hole. As the assembly fully enters the installation hole, the clip members 40 provide an outward spring pressure that pushes their front ends 44 into engagement with the interior of the installation hole in the door.

Referring to the fuse in FIG. 1, the holes 34 preferably include at least two holes adjacent to one another in spaced relation along the axis of the fuse. Two holes 34 are adjacent to one another in spaced relation along the sides of the fuse and three holes are adjacent in spaced relation along the top and bottom of the fuse. The walls formed between these multiple holes define the collapsing web that permits the pin 10 to move outward when exposed to the activating temperature.

The length of the pin and/or the properties of the fuse material along with the number and location of the holes 34 can be adjusted to provide a pin, which operates at the desired temperature and extends the desired distance outward from the front of the case. Variations in the length of the pin, the length of the fuse and the size of the case and spring may be made to make the pin assembly suitable for different applications.

By positioning the fuse outside the case, it is better exposed to the increased temperature of the fire, which provides more consistent and reliable operation. By adjusting the holes 34 defining the web portion of the fuse, the rate of collapse and the distance the pin extends as a function of the temperature may be adjusted for particular applications.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A thermally activated pin assembly comprising:

a case;

a pin received within the case and movable between a retracted position and an extended position, the pin having a front portion and a back portion, the front portion having a diameter greater than the back portion of the pin;

a spring applying a biasing force between the case and the pin to urge the pin towards the extended position;

a thermally activated, substantially cylindrical, fuse engaging the back portion of the pin and acting between the case and the back portion of the pin to hold the pin in the retracted position against the spring biasing force prior to activation, and a retaining ring mounted on the back portion of the pin;

the back portion of the pin extending through the fuse, the fuse being held in compression between the case and the retaining ring prior to thermal activation and the fuse allowing the pin to move to the extended position when the fuse is thermally activated.

2. The thermally activated pin assembly according to claim 1 wherein the fuse has a length and a diameter, the length of the fuse being greater than the diameter of the fuse.

3. The thermally activated pin assembly according to claim 1 wherein the fuse includes a plurality of holes formed perpendicular to a cylindrical axis of the fuse, the holes acting to weaken the fuse and allow the fuse to collapse at a desired thermal activation temperature.

4. The thermally activated pin assembly according to claim 1 wherein the fuse has a length and a diameter, the length of the fuse being greater than the diameter of the fuse.

5. The thermally activated pin assembly according to claim 1 wherein the fuse includes a plurality of holes formed therein, the holes acting to weaken the fuse and allow the fuse to collapse at a desired thermal activation temperature.

6. The thermally activated pin assembly according to claim 1 wherein the case includes a flange at a front end thereof.

7. The thermally activated pin assembly according to claim 6 wherein:

the case includes a body portion having a body diameter;

the case further includes at least one clip member at the front end thereof; and the flange has a flange diameter greater than the body diameter, the at least one clip member cooperating with the flange to hold the case within a mounting hole having a diameter greater than the body diameter and less than the flange diameter.

8. The thermally activated pin assembly according to claim 1 wherein the pin is longer than the case, the back portion of the pin extending out of the case and into the fuse, the spring acting to urge the back portion of the pin into the case and the fuse acting to prevent the back portion of the pin from moving into the case until the fuse is thermally activated.

9. A thermally activated pin assembly comprising:

a case;

a pin received within the case and movable between a retracted position and an extended position, the pin having a front portion and a back portion;

a spring applying a biasing force between the case and the pin to urge the pin towards the extended position; and a thermally activated fuse engaging the back portion of the pin and acting between the case and the back portion of the pin to hold the pin in the retracted position against the spring biasing force prior to activation, the fuse allowing the pin to move to the extended position when the fuse is thermally activated;

wherein:

the front portion of the pin has a diameter greater than the back portion of the pin;

the back portion of the pin extends though the spring; and prior to thermal activation of the fuse, the spring is held in compression between the case and an annular step formed at the diameter change between the front and back portions of the pin.

10. The thermally activated pin assembly according to claim 9 wherein the fuse includes a plurality of holes formed therein, the holes acting to weaken the fuse and allow the fuse to collapse at a desired thermal activation temperature.

11. The thermally activated pin assembly according to claim 9 wherein the case includes a flange at a front end thereof.

12. The thermally activated pin assembly according to claim 11 wherein:

the case includes a body portion having a body diameter;

the case further includes at least one clip member at the front end thereof; and the flange has a flange diameter greater than the body diameter, the at least one clip member cooperating with the flange to hold the case within a mounting hole having a diameter greater than the body diameter and less than the flange diameter.

13. The thermally activated pin assembly according to claim 9 wherein the pin is longer than the case, the back portion of the pin extending out of the case and into the fuse, the spring acting to urge the back portion of the pin into the case and the fuse acting to prevent the back portion of the pin from moving into the case until the fuse is thermally activated.

14. A thermally activated pin assembly comprising:

a case;

a pin received within the case and movable between a retracted position and an extended position, the pin having a front portion and a back portion;

a spring applying a biasing force between the case and the pin to urge the pin towards the extended position; and a thermally activated fuse engaging the back portion of the pin and acting between the case and the back portion of the pin to hold the pin in the retracted position against the spring biasing force prior to activation, the fuse allowing the pin to move to the extended position when the fuse is thermally activated;

wherein:

the case includes a restrictive opening sized to receive the back portion of the pin;

the back portion of the pin extends through the restrictive opening;

the spring is seated on one side of the restrictive opening of the case and acts to urge the pin away from the restrictive opening; and the fuse is located on the other side of the restrictive opening from the spring and acts to prevent the back portion of the pin from moving through the restrictive opening until the fuse is thermally activated.

15. The thermally activated pin assembly according to claim 14 wherein the fuse is substantially cylindrical, having a length and a diameter, the length of the fuse being greater than the diameter of the fuse.

16. The thermally activated pin assembly according to claim 14 wherein the front portion of the pin has a diameter greater than the back portion of the pin.

17. The thermally activated pin assembly according to claim 14 wherein the fuse includes a plurality of holes formed therein, the holes acting to weaken the fuse and allow the fuse to collapse at a desired thermal activation temperature.

18. The thermally activated pin assembly according to claim 14 wherein the case includes a flange at a front end thereof.

19. The thermally activated pin assembly according to claim 18 wherein:

the case includes a body portion having a body diameter;

the case further includes at least one clip member at the front end thereof; and the flange has a flange diameter greater than the body diameter, the at least one clip member cooperating with the flange to hold the case within a mounting hole having a diameter greater than the body diameter and less than the flange diameter.

20. The thermally activated pin assembly according to claim 14 wherein the pin is longer than the case, the back portion of the pin extending out of the case and into the fuse, the spring acting to urge the back portion of the pin into the case and the fuse acting to prevent the back portion of the pin from moving into the case until the fuse is thermally activated.

21. A thermally activated pin assembly comprising:

a case;

a pin received within the case and movable between a retracted position and an extended position, the pin having a front portion and a back portion;

a spring applying a biasing force between the case and the pin to urge the pin towards the extended position; and a thermally activated fuse engaging the back portion of the pin and acting between the case and the back portion of the pin to hold the pin in the retracted position against the spring biasing force prior to activation, the fuse allowing the pin to move to the extended position when the fuse is thermally activated;

wherein:

the front portion of the pin has a diameter greater than the back portion of the pin;

the back portion of the pin includes a retaining ring;

the case includes a restrictive opening sized to receive the back portion of the pin;

the fuse is substantially cylindrical and includes a plurality of holes extending perpendicular to a cylindrical axis of the fuse;

the back portion of the pin extends through the spring, the restrictive opening and the fuse; and prior to thermal activation of the fuse, the spring is held in compression between the restrictive opening of the case and an annular step formed at the diameter change between the front and back portions of the pin and the fuse is held in compression between the restrictive opening of the case and the retaining ring.

22. A thermally activated pin assembly comprising:

a substantially cylindrical case having:

a cylindrical body portion having a front end and a back end, the body portion having a body length and a body diameter, the back end having a restrictive opening therein with a diameter less than the body diameter a flange at a front end of the case having a flange diameter greater than the body diameter, and a plurality of clip members adjacent the flange for holding the case in a mounting hole;

a pin received within the case and movable between a retracted position and an extended position, the pin having a front portion and a back portion, the front portion of the pin having a diameter greater than the back portion of the pin, the back portion of the pin extending through the restrictive opening;

a spring having the back portion of the pin extending therethrough, the spring applying a biasing force between the restrictive opening of the case and an annular step formed at the diameter change between the front and back portions of the pin to urge the pin towards the extended position;

a retaining clip on the back portion of the pin; and a thermally activated substantially cylindrical fuse, the back portion of the pin extending through the fuse, the fuse acting between the restrictive opening of the case, opposite the spring, and the retaining clip on the back portion of the pin to hold the pin in the retracted position against the spring biasing force prior to activation, the fuse allowing the pin to move to the extended position when the fuse is thermally activated.

23. The thermally activated pin assembly according to claim 22 wherein the fuse has a length and a diameter, the length of the fuse being greater than the diameter of the fuse.

24. The thermally activated pin assembly according to claim 23 wherein the fuse includes at least two holes extending perpendicular to a cylindrical axis of the fuse and adjacent to one another in spaced relation along the axis of the fuse, the holes acting to weaken the fuse and allow the fuse to collapse at a desired thermal activation temperature.

25. The thermally activated pin assembly according to claim 22 wherein the fuse includes a plurality of holes extending perpendicular to a cylindrical axis of the fuse, the holes defining a web between the holes, the web controlling the fuse to provide a controlled collapse at a desired rate of collapse at a corresponding desired thermal activation temperature.

26. A thermally activated pin assembly comprising:

a case;

a pin received within the case and movable between a retracted position and an extended position, the pin having a front portion and a back portion, the front portion having a diameter greater than the back portion of the pin;

a spring applying a biasing force between the case and the pin to urge the pin towards the extended position;

a thermally activated fuse engaging the back portion of the pin and acting between the case and the back portion of the pin to hold the pin in the retracted position against the spring biasing force prior to activation, and a retainer mounted on the back portion of the pin, the back portion of the pin extending through the fuse, the fuse being held in compression between the case and the retainer prior to thermal activation and the fuse allowing the pin to move to the extended position when the fuse is thermally activated.

* * * * *